US009050737B1

(12) United States Patent
McDaniel

(10) Patent No.: US 9,050,737 B1
(45) Date of Patent: Jun. 9, 2015

(54) CHAINSAW CHAIN ORGANIZER

(71) Applicant: Marshall McDaniel, Dewey, OK (US)

(72) Inventor: Marshall McDaniel, Dewey, OK (US)

( * ) Notice: Subject to any disclaimer, the term of this patent is extended or adjusted under 35 U.S.C. 154(b) by 0 days.

(21) Appl. No.: 14/272,813

(22) Filed: May 8, 2014

Related U.S. Application Data

(60) Provisional application No. 61/951,030, filed on Mar. 11, 2014.

(51) Int. Cl.
*A45C 11/26* (2006.01)
*B27B 17/00* (2006.01)

(52) U.S. Cl.
CPC ..... *B27B 17/0008* (2013.01); *B27B 17/00* (2013.01)

(58) Field of Classification Search
CPC ..... B27B 17/00
USPC ..... 206/349, 348, 38, 806, 389, 407, 408
See application file for complete search history.

(56) References Cited

U.S. PATENT DOCUMENTS

| | | | | |
|---|---|---|---|---|
| 2,690,152 | A | 9/1954 | Riccio | |
| 3,862,686 | A * | 1/1975 | Kolarik et al. | 206/349 |
| D257,837 | S | 1/1981 | Pierce | |
| 4,352,432 | A * | 10/1982 | Smith | 211/19 |
| 4,805,889 | A | 2/1989 | Liepse | |
| 4,846,385 | A | 7/1989 | Fratus | |
| 4,905,948 | A | 3/1990 | Indorf | |
| 4,907,778 | A | 3/1990 | Rockwell | |
| 5,307,930 | A * | 5/1994 | Wilk et al. | 206/349 |
| 5,425,444 | A * | 6/1995 | Chapman | 206/6.1 |
| 6,715,608 | B1 * | 4/2004 | Moore | 206/397 |
| 7,624,862 | B1 * | 12/2009 | Pleggenkuhle | 206/349 |
| 8,360,264 | B2 * | 1/2013 | Tuominen et al. | 220/631 |
| 2003/0029748 | A1 * | 2/2003 | Hargrave-Thomas | 206/303 |

* cited by examiner

*Primary Examiner* — Steven A. Reynolds
*Assistant Examiner* — King M Chu
(74) *Attorney, Agent, or Firm* — Molly D. McKay

(57) ABSTRACT

A chainsaw chain organizer that is a hollow pipe or tube into which a loose chainsaw chain inserts via an open end of the tube. One end of the pipe is permanently sealed with a cap and an opposite open end is removably sealed with a second cap that is removed to insert the chain. Once the chain is inserted into the tube, a bolt is extended consecutively through a wall of the tube, through the center of the chain and then through an opposite wall of the tube and is secured with a wing nut. The second cap is then replaced on the open end of the tube. A handle is provided on the tube for carrying it and chain length can be written on the tube. An alternate embodiment has two tubes coupled together by a spacer and provided with a single handle for carrying both tubes.

8 Claims, 2 Drawing Sheets

CHAINSAW CHAIN ORGANIZER

CROSS-REFERENCE TO RELATED APPLICATIONS

The present application claims priority to U.S. Provisional Patent Application No. 61/951,030 filed on Mar. 11, 2014 for Chainsaw Chain Organizer.

BACKGROUND OF THE INVENTION

1. Field of the Invention

The present invention relates to a chainsaw chain organizer. More specifically, the present invention is a storage and carrying case for holding chainsaw chains in an organized and untangled arrangement.

2. Description of the Related Art

One problem with trying to store or organize loose chainsaw chains is that they tend to become curled back on themselves and their teeth engage so that it becomes difficult to untangle them.

Another problem with trying to organized loose chainsaw chains is that their teeth are sharp and tend to cut a person's hand when carrying or storing them.

Still a further problem with trying to organize loose chainsaw chains is it is difficult to determine the length of the loose chain when several different lengths of chains are being stored together.

The present invention addresses these problems by providing a hollow tube, such as a PVC pipe, into which an individual chain is inserted via an open end of the tube. Once inserted within the hollow interior of the tube, the chain is retained in an untangled position therein by means of a bolt that is removably inserted through the sides of the tube so that the bolt extends through the open center of the circular chainsaw chain located within the tube. Use of an eye bolt is recommended as the bolt can then be used as a means of hanging the organizer vertically for storage. When the organizer is stored vertically, the enclosed chain or chains are allowed to hang freely from the bolt, keeping them organized and untangled.

The tube is provided with cap means for removably sealing an open end of the tube to fully encase the chain within the tube. Once encased within the tube, the chain is no longer exposed to moisture that could rust the chain because the organizer is virtually weather proof. Also, the tube retains oil from the chains to prevent oily messes on storage areas. A handle on the tube allows for ease in carrying the case with chain inside. The length of chain enclosed within a tube can be written on the exterior of the tube to allow the user to distinguish and determine the length of chain enclosed within the tube without the need for removing the chain from the tube. Each tube can accommodate up to approximately 5 standard chainsaw chains. If multiple chains are to be stored in the same tube, it is recommended that the same length of chains be stored in the same tube.

In an alternate embodiment, individual tubes can be coupled together to make it easier to carry more than one tube and chain by grasping a single handle.

SUMMARY OF THE INVENTION

The present invention is a hollow tube into which an individual loose chainsaw chain is inserted via an open end of the tube. The tube can be constructed of PVC pipe, with one end of the pipe permanently sealed with a PVC cap that is glued onto the pipe and the other open end of the pipe provided with a removably second PVC cap that is not glued onto the pipe, but is instead just pressure fit onto the open end of the pipe.

This second PVC cap is removed to insert the chainsaw chain into the hollow interior of the pipe. Once inserted within the hollow interior of the tube, the chain is retained in an untangled position therein by means of a bolt that is removably inserted through the sides of the tube so that the bolt extends through the open center of the circular chainsaw chain located within the tube. The open end of the tube is then removably sealed with the second PVC cap means to fully encase the chain within the tube.

A handle is provided on the exterior of the tube for ease in carrying the case with chain inside. The length of chain enclosed within a tube can be written on the exterior of the tube to allow the user to distinguish and determine the length of chain enclosed within the tube without the need for removing the chain from the tube.

In an alternate embodiment, individual tubes can be coupled together to make it easier to carry more than one tube and chain by grasping a single handle.

DETAILED DESCRIPTION OF THE PREFERRED EMBODIMENT

Figure 1:
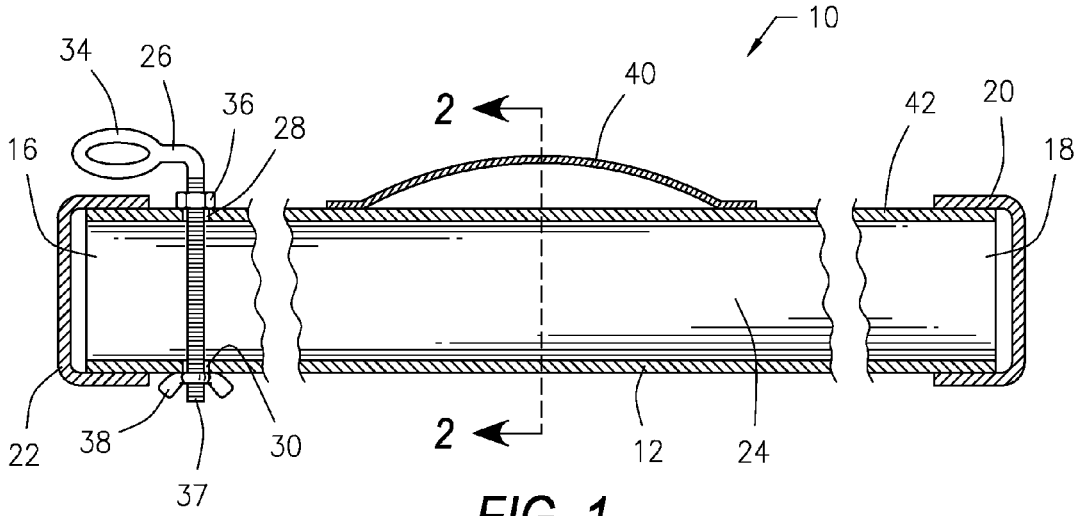
FIG. 1 is a partially cut away side view of a chainsaw chain organizer that is constructed in accordance with a preferred embodiment of the present invention.
Figure 2:
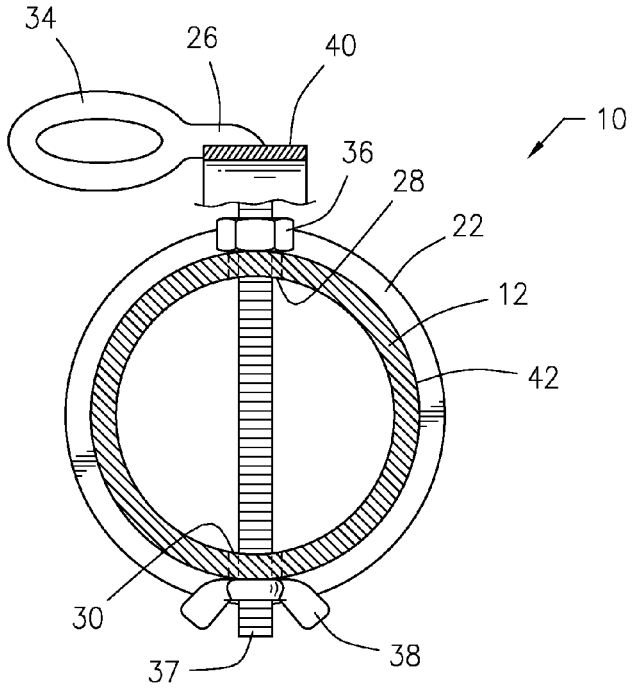
FIG. 2 is a cross sectional view taken along line 2-2 of FIG. 1.

Referring now to the drawings and initially to FIGS. 1 and 2, there is shown a chainsaw chain organizer 10 that is constructed in accordance with a preferred embodiment of the present invention. The organizer 10 is a hollow tube or pipe 12 into which an individual loose chainsaw chain 14 can be inserted via an open end 16 of the pipe 12. The pipe 12 can be constructed of PVC pipe, with a closed end 18 of the pipe 12 permanently sealed with a first PVC cap 20 that is glued or otherwise affixed onto the pipe 12 and the other open end 16 of the pipe 12 provided with a removable second PVC cap 22 that is not glued onto the pipe 12, but is instead just pressure fit onto the open end 16 of the pipe 12 so that the second cap 22 is removable.

The second PVC cap 22 is removed to insert a chainsaw chain 14 into the hollow interior 24 of the pipe 12. Once inserted within the hollow interior 24 of the pipe 12, the chain 14 is retained in an untangled position therein by means of a bolt 26 that is removably inserted through aligned bolt holes 28 and 30 provided in opposite sides of the pipe 12 so that the bolt 26 extends through the open center 32 of the circular chainsaw chain 14 located within the pipe 12. The bolt 26 is preferably an eye bolt 26 and is provided on its eye end 34 with a nut 36 and provided on its opposite distal end 37 with a wing nut 38. When the bolt 26 is secured through the pipe 12, the nut 36 and wing nut 38 are secured to the bolt 26 on opposite sides of the pipe 12, with both the nut 36 and the wing nut 38 abutting the pipe 12.

In order to insert the eye bolt 26 through the open center 32 of the chainsaw chain 14 while the chain 14 is located within the pipe 12, it is necessary to remove the wing nut 38 from the distal end 37 of the eye bolt 26 then pull the eye bolt 26 out of the bolt hole 30. Then the bolt 26 is inserted through the open center 32 of the chainsaw chain 14 before reinserting the eye bolt 26 through the bolt opening 30 and again securing the eye bolt 26 with the wing nut 38.

Once the chain 14 is thus secured within the pipe 12 with the bolt 26, the open end 16 of the pipe 12 is then removably sealed with the second PVC cap 22 to fully encase the chain 14 within the pipe 12.

Figure 3:
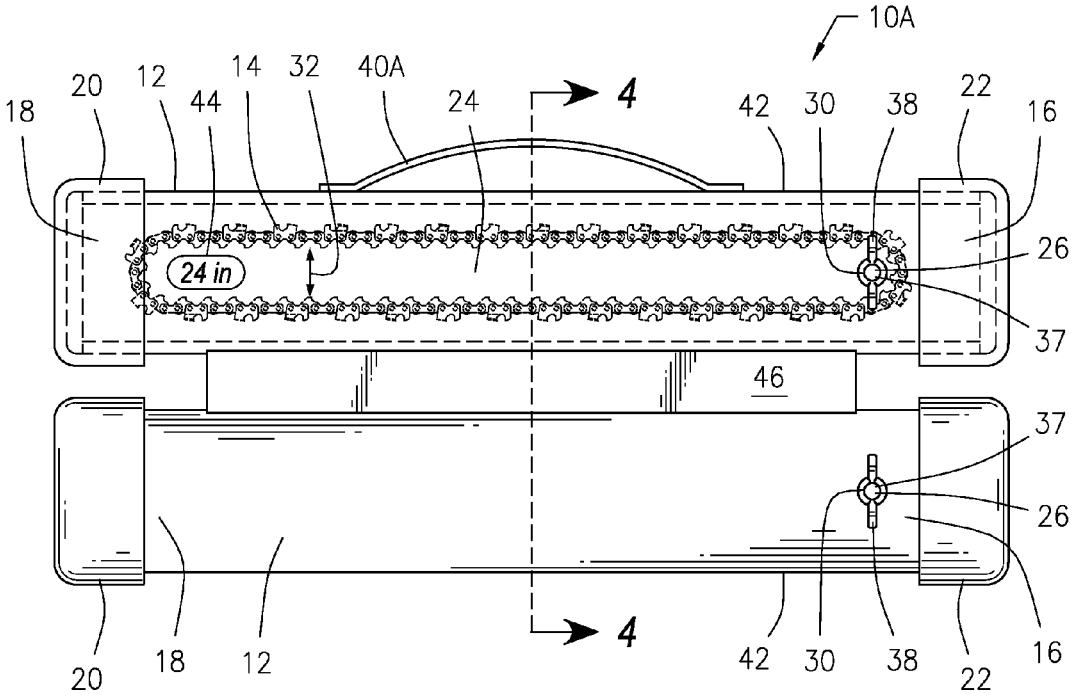
FIG. 3 is a side view of a chainsaw chain organizer that is constructed in accordance with an alternate embodiment of the present invention shown with a chainsaw chain located within the top pipe of the organizer.

A handle 40 is provided on the exterior 42 of the pipe 12 for ease in carrying the organizer 10 with the chain 14 inside. As shown in FIG. 3, the length 44 of the chain 14 that is enclosed within a pipe 12 can be written on the exterior of the pipe 12 to allow the user to distinguish and determine the length 44 of chain 14 enclosed within the pipe 12 without the need for removing the chain 14 from the pipe 12.

Figure 4:
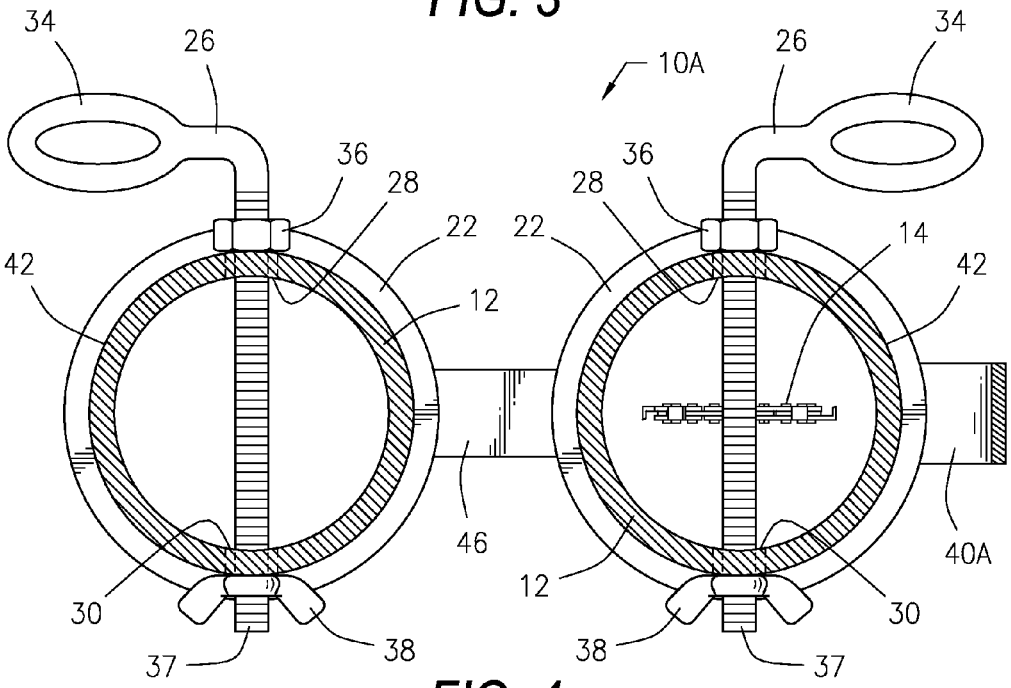
FIG. 4 is a cross sectional view taken along line 4-4 of FIG. 3.

Referring now to FIGS. 3 and 4, an alternate embodiment chainsaw chain organizer 10A is illustrated. The alternate organizer 10A employs two individual pipes 12 that are coupled together with a spacer 46. The alternate organizer 10A is designed to make it easier to carry two pipes 12 and their enclosed chains 14 by grasping a single common handle 40A.

Although the organizer 10 or 10A has been described as holding a single chain 14, it is not so limited. In fact, up to approximately five chains 14 can be stored within a single pipe 12. If more than one chain 14 is to be stored, it is recommended that all of the chains 14 stored within a single pipe 12 be of the same length 44. Also, the eye end 34 of the eye bolt 26 can be used to hang the organizer 10 or 10A in a vertical position. When the organizer 10 or 10A is stored in a vertical position, all of the chains 14 located therein will hang straight and vertically from the bolt 26 in an organized and untangled manner.

When the organizer 10 or 10A is sealed, chains 14 located inside the organizer 10 or 10A are not exposed to moisture since the organizer 10 or 10A is virtually weather proof. This prevents rusting of the stored chains 14.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A chainsaw chain organizer comprising:

a length of hollow tube having a closed end and an opposite open end through which individual loose chainsaw chains can be inserted into a hollow interior of the tube, a removable cap provided on the open end to removable seal chainsaw chains within the tube, a retainer extending through the tube from side to side as a means for holding chainsaw chains in untangled positions within the tube by inserting the bolt through open centers of the circular chainsaw chains, the tube is constructed of a length of PVC pipe, and said closed end is sealed with a first PVC cap.

2. A chainsaw chain organizer according to claim 1 wherein said removable cap is constructed of a second PVC cap.

3. A chainsaw chain organizer according to claim claim 1 wherein said retainer further comprises:

a bolt that removably inserts through aligned holes provided in opposite sides of the tube, and a nut that secures to the bolt to hold the bolt in the aligned holes.

4. A chainsaw chain organizer according to claim 3 wherein said bolt is an eye bolt.

5. A chainsaw chain organizer according to claim 4 wherein said nut is a wing nut.

6. A chainsaw chain organizer according to claim claim 1 further comprising:

a handle provided on the tube as a means of carrying the tube.

7. A chainsaw chain organizer according to claim claim 1 wherein two tubes are coupled together with a spacer.

8. A chainsaw chain organizer according to claim 7 further comprising:

a single common handle attached to at least one of the tubes.

* * * * *